US005729832A

United States Patent [19]

Grilliot et al.

[11] Patent Number: 5,729,832

[45] Date of Patent: Mar. 24, 1998

[54] PROTECTIVE GARMENT CONTAINING PUNCTURE-RESISTANT AND/OR FOREARM PORTIONS

[75] Inventors: William L. Grilliot; Mary I. Grilliot, both of Dayton, Ohio

[73] Assignee: Morning Pride Manufacturing, Inc., Dayton, Ohio

[21] Appl. No.: 370,799

[22] Filed: Jan. 10, 1995

Related U.S. Application Data

[63] Continuation of Ser. No. 21,399, Feb. 23, 1993, abandoned.

[51] Int. Cl.[6] ..... A41D 13/00

[52] U.S. Cl. ..... 2/23; 2/2.5; 2/24; 2/79; 2/81; 2/458

[58] Field of Search ..... 2/2, 2.5, 22, 23, 2/24, 62, 79, 81, 227, 228, 267, 455, 456, 458

[56] References Cited

U.S. PATENT DOCUMENTS 4,688,269 8/1987 Maeshima ..... 2/2

5,052,052 10/1991 Gilford et al. ..... 2/2

FOREIGN PATENT DOCUMENTS 2199233 7/1988 United Kingdom ..... 2/23

*Primary Examiner*—Diana Biefeld

*Attorney, Agent, or Firm*—Dressler, Rockey, Milnamow & Katz

[57] ABSTRACT

The present invention is a protective garment comprising a puncture-resistant member disposed so as to protect the knee portions and forearm portions of the garment from injury from sharp objects. The protective garment of the present invention comprises an upper body portion comprising a torso portion and two arm portions and a trousers portion comprising a torso portion and two leg portions, and comprising a material providing abrasion resistance to the garment and providing thermal protection to the wearer. The dorsal forearm portions and ventral knee joint portions each comprise a puncture-resistant member disposed so as to protect these portions of the garment from complete puncture, thereby protecting the emergency worker from injury from sharp objects, such as hypodermic needles.

4 Claims, 4 Drawing Sheets

PROTECTIVE GARMENT CONTAINING PUNCTURE-RESISTANT AND/OR FOREARM PORTIONS

This application is a continuation of application Ser. No. 08/021,399, filed Feb. 23, 1993, now abandoned.

BACKGROUND OF THE INVENTION

The environment in which an emergency worker, such as a firefighter, works offers several hazards to life and limb. These include the well-known dangers of fire, smoke, and collapsing structures.

In recent years a new danger has been added to those faced by emergency workers, such as firefighters.

Many fires, particularly in urban areas, occur in structures where intravenous drug use has occurred. These structures may be abandoned houses where addicts congregate, or in structures where drugs are otherwise sold or used. Such structures are often littered with drug paraphernalia, including hypodermic needles. Used hypodermic needles can carry a wide variety of diseases, especially when they have been shared among several addicts.

It is often difficult if not impossible for the firefighter, engaged in firefighting and rescue activity, to be conscious of this danger. Also, hypodermic needles and similar dangerous sharp objects are often difficult or impossible to see or recognize in the firefighting environment, which is commonly poorly lit and smoke-filled.

Other fires occur under circumstances where there is a danger that the protective garment might otherwise be punctured, increasing the danger to the emergency worker.

The emergency worker, once injured, is often unaware of the injury and may be in situations where he or she is unable to seek immediate medical treatment. Such conditions increase the possibility that a puncture would lead to infection.

The danger to the emergency worker is particularly acute when, as is often the case, the emergency worker is called upon to kneel or crawl through burning or smoking structures. In such cases, a emergency worker's knees and/or forearms are particularly vulnerable because a great deal of the emergency worker's weight is borne by the emergency worker's knee(s) and/or forearms when kneeling or crawling. Also, during crawling, a great deal of force is transmitted through the knees and/or forearms, increasing the likelihood that, if encountered, would be forced into and through the garment and into the tissue of the emergency worker's knee joint and/or forearm area. Puncture wounds are particularly dangerous in firefighting environments due to the combination of the generally unsanitary conditions and the fact that puncture wounds are more likely to carry infection into the bloodstream. Infections which might be transmitted by such punctures include tetanus, hepatitis and acquired immune deficiency syndrome (AIDS).

Another reason to prevent puncture of the emergency worker's garment is to maintain the functional integrity of the garment's layer, such as the thermal layer and the moisture barrier layer. Punctures can destroy this integrity, allowing the emergency worker to become wet in the knee area which increases the likelihood of burning.

Protective garments generally are designed for the purposes of providing an abrasion resistant, as well as thermal protection and moisture resistance. Abrasion resistance is normally provided by an abrasion-resistant outer layer while thermal protection and moisture resistance are normally provided by inner layers of the garment. Modern protective garments generally have three layers for these respective purposes, and such garments are exemplified by those taught in U.S. Pat. Nos. 4,897,886; 5,001,783; and 5,038,410, all to Grilliot et al., which are hereby incorporated herein by reference.

Recent advances have made possible single layer protective garments which perform all of the aforementioned functions.

However, in either case, such materials are designed for their specific purposes, such as thermal barrier or moisture barrier functions, and are not capable of resisting puncture. This is particularly so as many of the layers of known protective garments are of light weight material, particularly unsuited to resist puncture.

Some protective garments, such as that taught in U.S. Pat. No. 5,050,244 to Kleinman features knee pads of woven material appropriate to provide padding for the purpose of absorbing shock. However, such garments are not capable of providing protection against puncture as the material taught by Kleinman would be susceptible to puncture by sharp objects.

Accordingly, it is desirable to be able to provide all of the normal functions of modern protective garments while providing the knee and forearm portions with effective protection from puncture.

Additional advantages may become apparent to one of ordinary skill in the art from the present disclosure or through practice of the present invention.

SUMMARY OF THE INVENTION

The present invention is a protective garment comprising a puncture-resistant member disposed so as to protect the knee portions and forearm portions of the garment from injury from sharp objects.

The protective garment of the present invention comprises an upper body portion comprising a torso portion and two arm portions and comprising a material providing abrasion resistance to the garment and providing thermal protection to the wearer. The arm portions are adapted to cover an arm extremity, each arm portion having a dorsal forearm portion. As used herein, the term "dorsal forearm portion" is intended to refer to that portion of the garment adapted to cover the dorsal forearm from the wrist to the elbow, inclusive (that is, that portion of the forearm resting on the ground when in an arms-and-knees crawling position). The dorsal forearm portions each comprise a puncture-resistant member disposes so as to protect at least a portion of the dorsal forearm portion of the garment from complete puncture, thereby protecting the emergency worker from injury from sharp objects, such as hypodermic needles.

The protective garment of the present invention also comprises a trousers portion comprising a torso portion and two leg portions and comprising a material providing abrasion resistance to the garment and providing thermal protection to the wearer. The leg portions are adapted to cover a leg extremity, each leg portion having a ventral knee joint portion adapted to cover a ventral knee joint of the leg extremity. The ventral knee joint portions each comprise a puncture-resistant member disposed so as to protect the ventral knee joint portion of the garment from complete puncture, thereby protecting the firefighter from injury from sharp objects such as hypodermic needles. As used herein, the term "ventral knee joint portion" is intended to mean that portion of the firefighter's garment that covers the frontal portion of the knee joint.

The abrasion resistance and thermal protection function of the protective garment of the present invention may be provided by one or more than one layer. The protective garment may also comprise a material which, in addition to abrasion resistance and thermal protection function, provides a moisture barrier function. These functions may also be provided by a multi-layer garment.

The puncture-resistant member may be incorporated into the protective garment in a variety of ways. It may be disposed on or beneath any single or multiple layer construction, or between any two layers. For instance, the puncture-resistant member may be separately incorporated outside the outermost layer (i.e., normally the abrasion-resistant layer), or inside the innermost layer (i.e., normally the moisture barrier layer), with corresponding enclosure layers of material to support the puncture-resistant member against such innermost or outermost layers). The puncture-resistant member may be permanently or removably incorporated by any appropriate permanent or temporary attachment means such as stitching, or the use of snaps, hook and loop fasteners as sold under the registered trademark Velcro, zippers. Such a construction may also involve the formation of a pocket on the innermost or outermost layer so that the puncture-resistant member can be inserted and removed in order that the garment can be cleaned. Such a pocket construction may be provided with a closure means, such as snaps, zippers or Velcro closures to secure the puncture-resistant member in the pocket.

It is preferred that the puncture-resistant member be disposed in a pocket of abrasion-resistant material on the outside garment (usually on the outer abrasion resistant layer), so that it protects the entire garment from puncture with a sacrificial layer of abrasion-resistant material to allow the protective garment to continue to maintain its functional integrity. A pocket construction is also preferred to allow for the removal of the puncture-resistant member prior to cleaning the garment.

The puncture-resistant member may be made of any appropriate puncture-resistant material, such as hard plastics and metals. It is preferred that the puncture-resistant member be made of a hard, lightweight plastic, such as ABS plastic, which are preferred due to their resistance to heat and low heat conductivity.

It is also preferred that the puncture-resistant member be covered by a padding material. Such material may be selected from any woven material or polymeric materials. If used, the polymeric material should be resistant to high temperatures and should be relatively non-flammable so as to meet governing NFPA guidelines. An example of an acceptable material is nitrogen-blown neoprene rubber.

DETAILED DESCRIPTION OF THE PREFERRED EMBODIMENT

Figure 1:
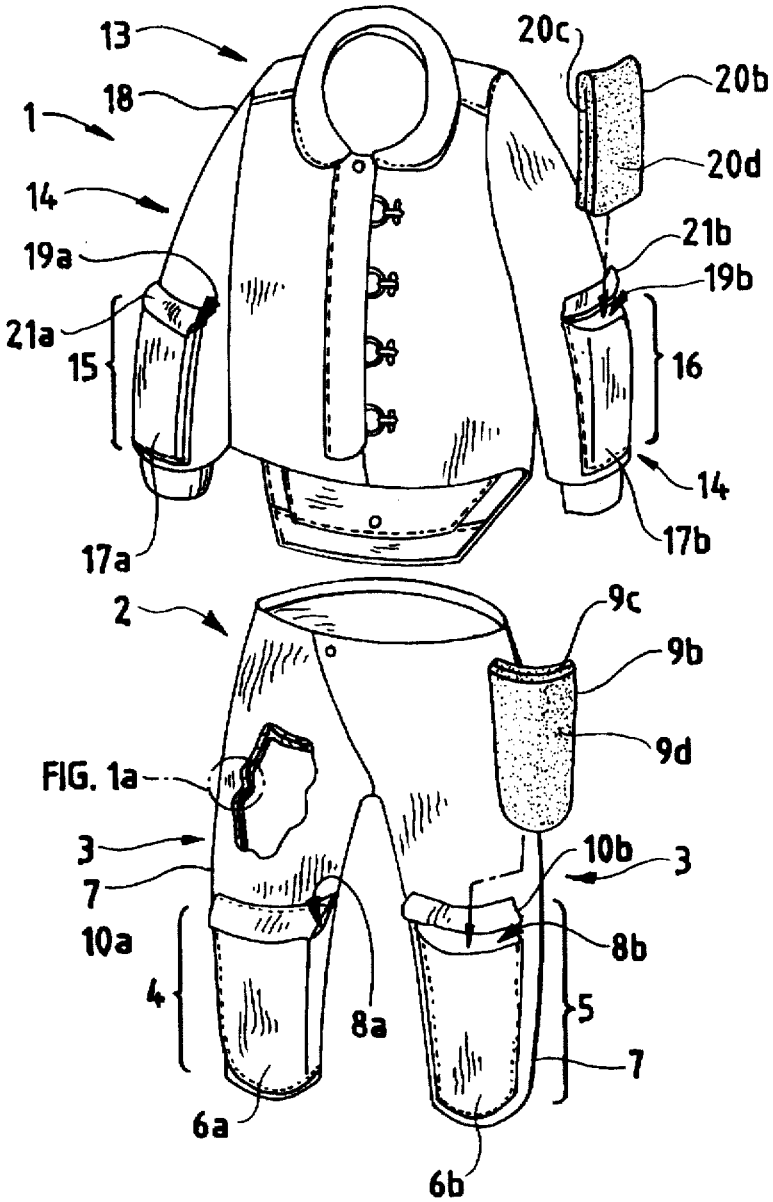
FIG. 1 is a plan view of a protective garment in accordance with one embodiment of the present invention, with detailed cross-section.
Figure 1A:
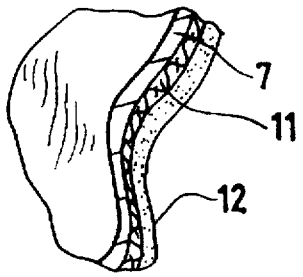

In accordance with the foregoing summary, the following is a detailed description of the preferred embodiments of the present invention, one of which is also presently considered to be the best mode of the invention. FIG. 1 shows what is presently considered to be the best mode of the invention.

FIG. 1 shows protective garment 1 which comprises trousers 2. Trousers 2 have leg extremity portions 3 which contain knee portions shown generally by brackets 4 and 5. The knee portions are provided with pad pockets **6*a* and 6*b* which are sewn onto outer abrasion resistant layer 7, which covers moisture barrier layer 11 and thermal barrier layer 12. Pad pockets 6*a* and 6*b* have pocket openings 8*a* and 8*b*, respectively, into which the puncture-resistant members such as 9*b* can be inserted. Pad pockets 6*a* and 6*b* may be closed by any closure means (i.e., by flaps 10*a* and 10*b*** carrying hook and loop fasteners such as sold under the registered trademark Velcro, respectively).

FIG. 1 also shows jacket 13 having arm portions 14 which in turn have dorsal forearm portions extending from (and including) the elbow to (and including) the wrist, shown generally by brackets 15 and 16. The dorsal forearm portions are provided with pad pockets **17*a* and 17*b* which are sewn onto outer abrasion resistant layer 18 which covers moisture barrier layer and thermal barrier layer (not shown) in the same fashion as shown with respect to trousers 2. Pad pockets 17*a* and 17*b* have pocket openings 19*a* and 19*b*, respectively, into which the puncture-resistant members such as 20*b* can be inserted. Pad pockets 17*a* and 17*b* may be closed by any closure means (i.e., by flaps 21*a* and 21*b*** carrying hook and loop fasteners such as sold under the registered trademark Velcro, respectively).

Preferably, puncture-resistant members, such as **9*b* and 20*b*, comprise a hard plastic core 9*c* and 20*c* respectively, such as a core of ABS plastic. Most preferred is to cover the hard plastic core with a soft pad material, such as a layer of neoprene rubber, shown as layers 9*d* and 20*d***, respectively.

Figure 2:
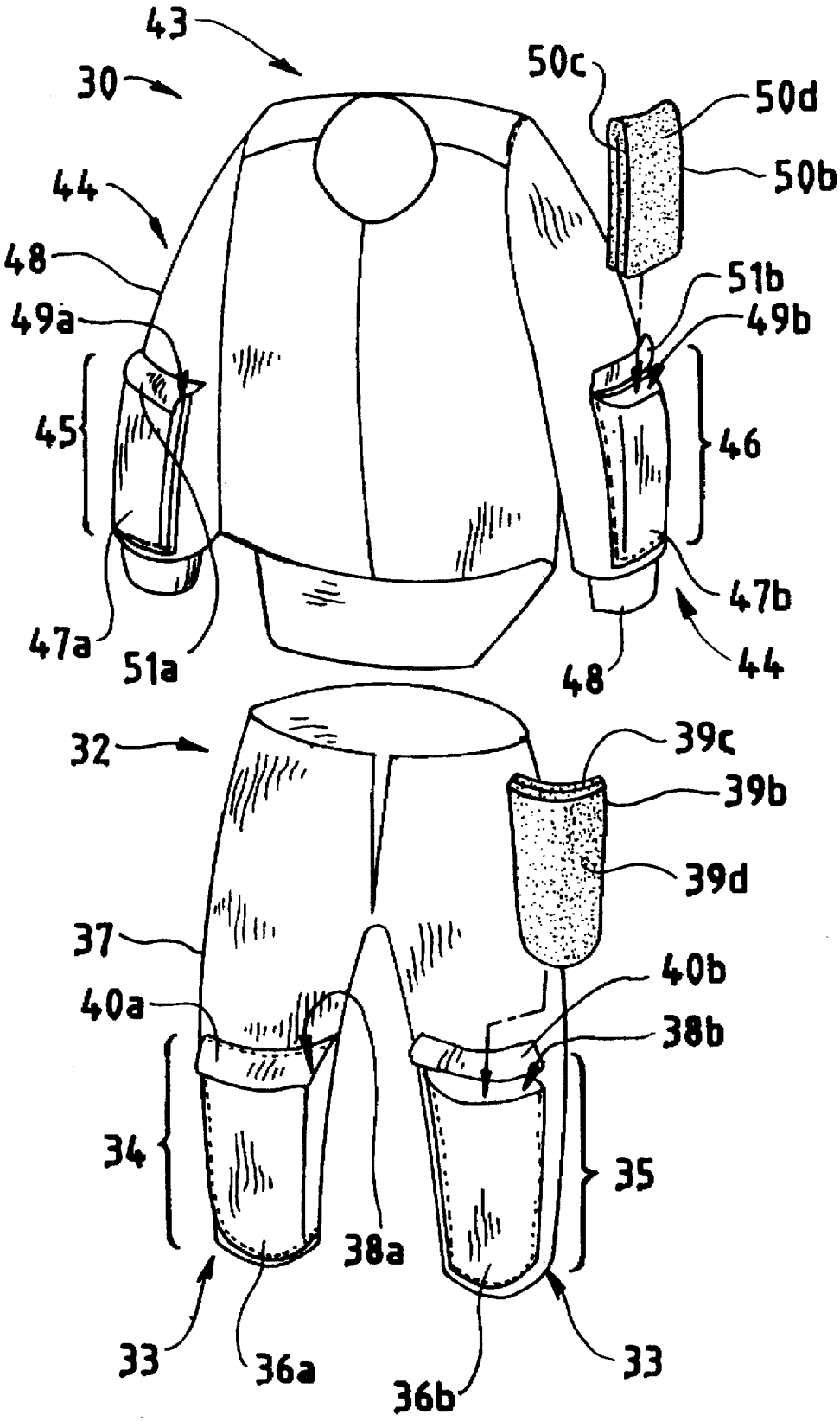
FIG. 2 is a sectioned view of the moisture barrier portion of a protective garment in accordance with another embodiment of the present invention.

FIG. 2 shows an alternative embodiment of the present invention. FIG. 2 shows only the moisture barrier layer of a protective garment, such as a firefighter's garment, having been removed from the outer abrasion resistant layer of the garment (not shown).

FIG. 2 shows that the puncture-resistant member may be disposed on one side of the moisture barrier layer material. FIG. 2 shows the moisture barrier material 30 of a protective garment, which comprises trousers portion 32. Trousers portion 32 has leg extremity portions 33 which contain knee portions shown generally by brackets 34 and 35. The knee portions are provided with pad pockets **36*a* and 36*b* which are sewn onto moisture barrier material layer 37, which covers a thermal barrier material layer (not shown), and is covered by an abrasion resistant layer (not shown) in the same fashion as is shown in FIG. 1. Pad pockets 36*a* and 36*b* have pocket openings 38*a* and 38*b*, respectively, into which the puncture-resistant members such as 39*b* can be inserted. Pad pockets 36*a* and 36*b* may be closed by any closure means (i.e., by flaps 40*a* and 40*b*** carrying hook and loop fasteners such as sold under the registered trademark Velcro, respectively).

FIG. 2 also shows jacket portion 43 having arm portions 44 which in turn have dorsal forearm portions extending from (and including) the elbow to (and including) the wrist, shown generally by brackets 45 and 46. The dorsal forearm portions are provided with pad pockets **47*a* and 47*b* which are sewn onto moisture barrier material layer 48 which covers thermal barrier material layer (not shown), and is covered by an abrasion resistant layer (not shown) in the same fashion as is shown in FIG. 1. Pad pockets 47*a* and 47*b* have pocket openings 49*a* and 49*b*, respectively, into which the puncture-resistant members such as 50*b* can be inserted. Pad pockets 47*a* and 47*b* may be closed by any closure means (i.e., by flaps 51***a* and 51*b* carrying hook and loop fasteners such as sold under the registered trademark Velcro, respectively).

Preferably, puncture-resistant members, such as 39*b* and 50*b*, comprise a hard plastic core 39*c* and 50*c* respectively, such as a core of ABS plastic. Most preferred is to cover the hard plastic core with a soft pad material, such a layer of neoprene rubber, shown as layers 39*d* and 50*d*, respectively.

Figure 3:
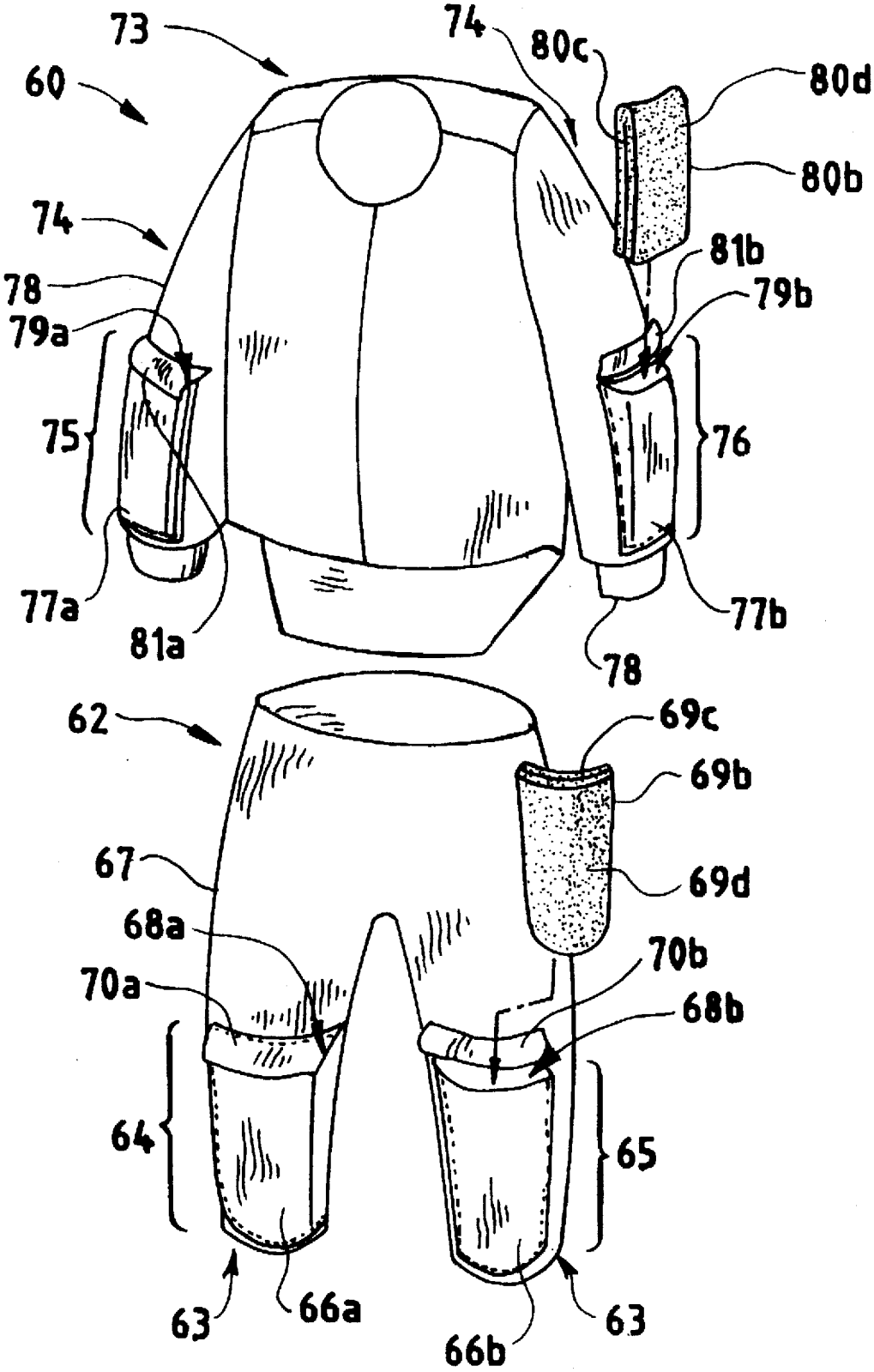
FIG. 3 is a sectioned view of the thermal barrier portion of a protective garment in accordance with yet another embodiment of the present invention.

FIG. 3 shows an alternative embodiment of the present invention. FIG. 3 shows only the thermal barrier material layer of a protective garment, such as firefighter's garment, having been removed from the outer abrasion resistant layer of the garment (not shown).

FIG. 3 shows that the puncture-resistant member may be disposed on the outside of the thermal barrier material layer. FIG. 3 shows the thermal barrier material layer 60 of a protective garment, which comprises trousers portion 62. Trousers portion 62 has leg extremity portions 63 which contain knee portions shown generally by brackets 64 and 65. The knee portions are provided with pad pockets 66*a* and 66*b* which are sewn onto thermal barrier material layer 67, which is covered by a moisture barrier material layer (not shown) and by an abrasion resistant layer (not shown), in the same fashion as is shown in FIG. 1. Pad pockets 66*a* and 66*b* have pocket openings 68*a* and 68*b*, respectively, into which the puncture-resistant members such as 69*b*can be inserted. Pad pockets 66*a* and 66*b* may be closed by any closure means (i.e., by flaps 70*a* and 70*b* carrying hook and loop fasteners sold under the registered trademark Velcro, respectively).

FIG. 3 also shows jacket 73 having arm portions 74 which in turn have dorsal forearm portions extending from (and including) the elbow to (and including) the wrist, shown generally by brackets 75 and 76. The dorsal forearm portions are provided with pad pockets 77*a* and 77*b* which are sewn onto thermal barrier material layer 78 which is covered by a moisture barrier material layer (not shown) and by an abrasion resistant layer (not shown) in the same fashion as is shown in FIG. 1. Pad pockets 77*a* and 77*b* have pocket openings 79*a* and 79*b*, respectively, into which the puncture-resistant members such as 80*b* can be inserted. Pad pockets 77*a* and 77*b* may be closed by any closure means (i.e., by flaps 81*a* and 81*b* carrying hook and loop fasteners such as sold under the registered trademark Velcro, respectively).

Preferably, puncture-resistant members, such as 69*b* and 80*b* comprise a hard plastic core 69*c* and 80*c* respectively, such as a core of ABS plastic. Most preferred is to cover the hard plastic core with a soft pad material, such as a layer of neoprene rubber, shown as layers 69*d* and 80*d*, respectively.

Figure 4:
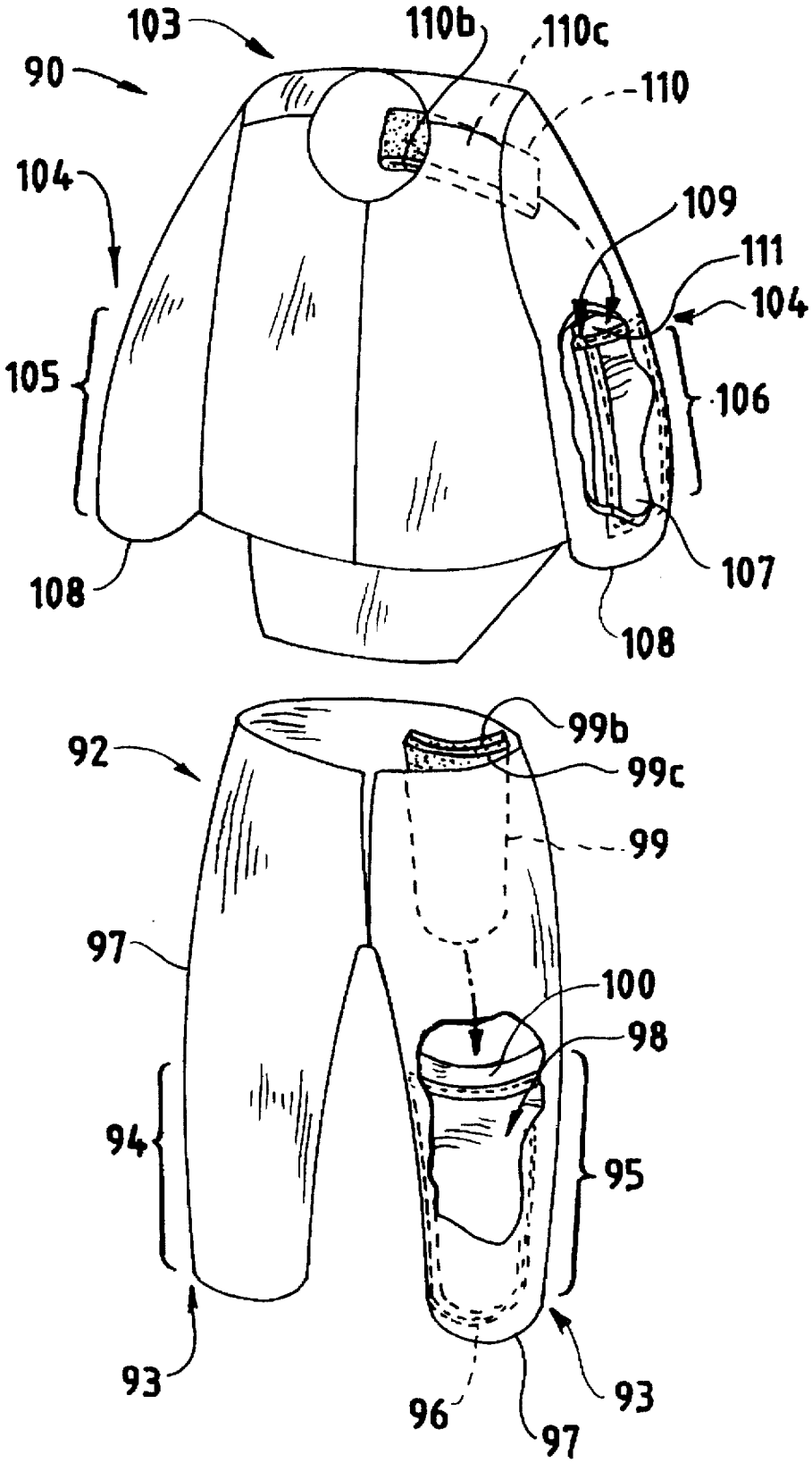
FIG. 4 is a sectioned view of the thermal barrier portion of a protective garment in accordance with yet another embodiment of the present invention.

FIG. 4 shows an alternative embodiment of the present invention. FIG. 4 shows only the thermal barrier material layer 90 of a protective garment, such as firefighter's garment, having been removed from the outer abrasion resistant layer of the garment (not shown).

FIG. 4 shows that the puncture-resistant member may be disposed on the inside of the thermal barrier material layer. FIG. 4 shows the thermal barrier material layer 90 of a protective garment which comprises trousers portion 92. Trousers portion 92 has leg extremity portions 93 which contain knee portions shown generally by brackets 94 and 95. The knee portions are provided with pad pockets, such as pad pocket 96 which are sewn onto the underside of thermal barrier material layer 97 which is covered by a moisture barrier material layer (not shown) and an abrasion resistant material layer (not shown), in the same fashion as is shown in FIG. 1. Pad pockets such as 96 have pocket openings such as 98 into which the puncture-resistant members such as 99 can be inserted. Pad pockets such as 96 have pocket openings such as 98 into which the puncture-resistant members such as 99 can be inserted. Pad pockets such as 96 may be closed by any closure means (i.e., by flaps 100 carrying hook and loop fasteners such as sold under the registered trademark Velcro).

FIG. 4 also shows jacket portion 103 having arm portions 104 which in turn have dorsal forearm portions extending from (and including) the elbow to (and including) the wrist, shown generally by brackets 105 and 106. The dorsal forearm portions are provided with pad pockets such as 107 which are sewn onto the underside of thermal barrier material layer 108 which is covered by a moisture barrier material layer (not shown) and by an abrasion resistant material layer (not shown) in the same fashion as is shown in FIG. 1. Pad pockets such as 107 have pocket openings such as 109 into which the puncture-resistant members such as 110 can be inserted. Pad pockets such as 107 may be closed by any closure means (i.e., by flaps 111 carrying hook and loop fasteners such as sold under the registered trademark Velcro).

Preferably, puncture-resistant members, such as 99 and 110, comprise a hard plastic core 99*b* and 110*b* respectively, such as a core of ABS plastic. Most preferred is to cover the hard plastic core with a soft pad material, such as a layer of neoprene rubber, shown as layers 99*c* and 110*c*, respectively.

Regardless of the specific embodiment employed, it is preferred that the puncture-resistant member of the invention be able to withstand a force of at least 50 lbf. The standard test used by the NFPA (National Fire Protection Association) to test for puncture resistance of footwear is under section 5.3 of CSA Z195-M, Standard for Protective Footwear, Occupational Health and Safety. The same test can be used to establish the puncture resistance of the protective knee or dorsal forearm pad. It will be understood that other comparable tests for determining puncture resistance can be used if desired.

In accordance with the foregoing disclosure, it will be within the ability of one of ordinary skill in the art to make modifications and alterations, including the integration or disintegration of parts, and the substitution of equivalent materials to practice the invention without departing from its spirit as reflected in the appended claims.

What is claimed is:

1. Protective garment trousers for a firefighter or emergency worker, said trousers comprising:

(a) a torso portion and two leg portions, said leg portions adapted to cover a leg extremity having a knee joint, each of said leg portions having a ventral knee joint portion adapted to cover the ventral portion of said knee joint of said leg extremity;

(b) said torso portion and two leg portions comprising a first layer of abrasive resistant material, a second layer of thermal insulating material and a third layer of moisture resistant material; and (c) a member puncture-resistant to at least 50 lbf. supported by said ventral joint portions and disposed so as to protect the ventral portion of the knee joint comprising a core of puncture-resistant material at least partially covered by a soft pad material.

2. The trousers according to claim 1, wherein the puncture-resistant material is metal.

3. The trousers according to claim 1, wherein the puncture-resistant material is ABS plastic.

4. The garment according to claim 1 wherein the soft pad material comprises neoprene rubber.

* * * * *